United States Patent [19]

Hoffman

[11] Patent Number: 4,719,702

[45] Date of Patent: Jan. 19, 1988

[54] UTENSIL HAND GUARD

[76] Inventor: Paul J. Hoffman, P.O. Box 2501, Appleton, Wis. 54913

[21] Appl. No.: 893,812

[22] Filed: Aug. 6, 1986

[51] Int. Cl.[4] ..... A47J 43/28

[52] U.S. Cl. ..... 30/326; 30/324

[58] Field of Search ..... 30/123, 295, 324, 326, 30/329, 322, 323; D7/141, 144, 145, 146

[56] References Cited

U.S. PATENT DOCUMENTS 2,787,055 4/1957 Wertz ..... 30/295 X 2,889,624 6/1959 McDonald ..... 30/324

3,839,793 10/1974 Crapio ..... 30/123

3,854,478 12/1974 Cunningham ..... 30/326

*Primary Examiner*—E. R. Kazenske

*Assistant Examiner*—Eugenia A. Jones

*Attorney, Agent, or Firm*—Robert M. Phipps

[57] ABSTRACT

An utensil for feeding infants and small children is which an elastomeric handguard is mounted around the utensil handle near the food carrying portion of the utensil, e.g. spoon bowl. The removable guard has an object such as an amusing face thereon facing the child.

5 Claims, 5 Drawing Figures

UTENSIL HAND GUARD

BACKGROUND

1. Field of the Invention

This invention relates to hand guards for eating utensils used in feeding infants and small children.

2. Description of the Prior Art

Various attachments for eating utensils used by infants and small children have previously been proposed. In U.S. Pat. No. 2,787,055 J. L. Wertz proposed mounting on a spoon a large diameter face of a clown which hid the hand of the person feeding the child. The face was at right angles to the spoon handle. Because the face was comparatively thin with respect to the diameter a special hub was required to support the guard on the spoon.

In U.S. Pat. No. 3,839,793 A. Crapio proposed a clown face guard for children's eating utensils. The utensil was also inserted through the thin clown face. However, as support for his face the face was partially incorporated in and the rear braced by an electric battery case. This support system and the locking screws made the utensil awkward to use and clean and thus the device was impractical in terms of modern living.

Unfortunately these prior devices hindered the feeding of the child since the utensil could not be tipped forward (up) to assist the child in removing the food. Additionally, the comparatively large diameter made the utensil unwieldy.

It is an object of this invention to provide an useful hand guard for children's eating utensils. It is a further object of this invention to provide amusement for the child while being fed. Still other objects will be apparent to those skilled in the art upon reference to the following detailed description.

SUMMARY OF THE INVENTION

In accordance with this invention there is provided a device for hand feeding infants and small children comprising in combination an utensil and an elastomeric hand guard which is fitted around the utensil handle near the food carrying portion of said utensil, said guard having a broad surface facing but sloping away from said food portion and simulating an object on said slope, said guard having a base portion which extends along said handle portion for such a length as to be directly under at least a third of said sloping surface.

DESCRIPTION OF THE PREFERRED EMBODIMENTS

Figure 1:
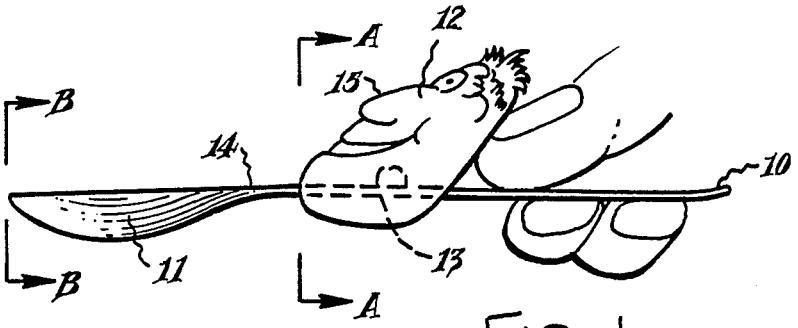
FIG. 1 is a view in vertical longitudinal section through the hand guard and utensil.

In FIG. 1 the illustrated utensil 14 is a spoon which has handle 10 and bowl 11. However, the utensil 14 may be a fork depending on the feeder's choice and food being fed to the small (young) child or infant. Over and down the length of the handle 10 is slipped hand guard 12 until the guard 12 comes into proximity of spoon bowl 11. The actual positioning may be made as desired by the user.

Figure 2:
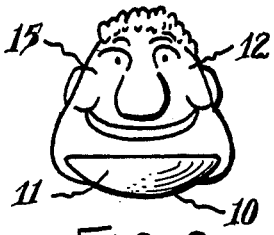
FIG. 2 is an end view of the hand guard and utensil of FIG. 1 at line B–B'.

When the utensil 14 is a spoon FIG. 2 illustrates the appearance of the combination of hand guard 12 of this invention with the spoon when viewed at line B–B' of FIG. 1.

Figure 3:
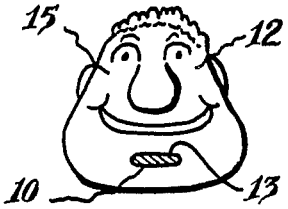
FIG. 3 is a cross sectional view of the hand guard and utensil taken along line A–A' of FIG. 1.

FIG. 3, which is a cross section of the combined hand guard 12 and utensil 14 of FIG. 1 along line A–A', shows the position of the handle 10 within channel 13 of the guard 12. Because the guard 12 is made of an elastomeric composition, e.g., natural or synthetic rubber, urethane, the channel 13 closes around and grips handle 10 so that guard 12 is securely retained upon the handle 10. Yet, at anytime guard 12 may be removed for cleaning or substitution by another guard 12 which has a different face or other object.

Figure 4:
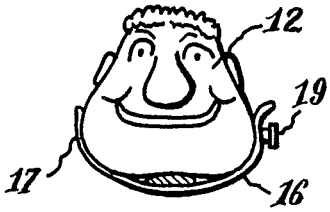
FIG. 4, an alternative to FIG. 3, is a cross sectional view of a hand guard and utensil taken along line A–A' of FIG. 1.
Figure 5:
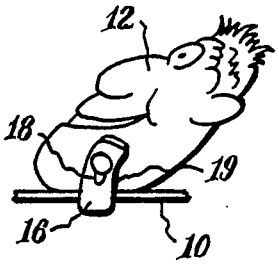
FIG. 5 is a longitudinal view of the hand guard of FIG. 4 and utensil handle ajacent the hand guard.

Alternatively, as shown in FIG. 4 channel 13 may be replaced by an elastomeric strap 16 which is fixed to and a part of hand guard 12 at one end 17, passes under utensile handle 10 and is then attached at the other end by slipping the slit 18 of the strap 16 over hook or knob 19 on the other side of the hand guard 10. The same effect would be obtained by the use of a snap in place of knob 19 in combination with slit 18 or other like fasteners and spring clamps. The attachment of strap 16 on the knob 19 is further shown in FIG. 5. The width of strap 16 can be varried as desired, depending on the desired artistic effect and the like.

Hand guard 12 is so constructed that it has a rearward slope from the food carrying portion of utensil 14, e.g. bowl 11. The angle of the slope is substantial so as to allow the utensil to be tipped forward (raised up) to assist in removal of the food without poking the child in the face as occurred with prior art devices. A preferred angle of slope between face surface 15 of the guard 12 and handle 10 would be about 20° to 60° and more preferably from about 30° to about 50°. As will be seen in FIG. 1 the base of guard 12 extends along handle 10 for a distance relative to the length of the sloping face 15. This distance is at least a third of the length of the sloping face or other object and preferably one half or more of the length. The large base provides positive stability to the guard when the child is want to play with the utensil.

Hand guard 12 has been shown in the drawings with a face 15. However, the object 15 can be an animal, e.g, a cat or a dog, a cartoon character, e.g. Popeye ®, a merchandising character, or an inanimate object such as a locomotive, airplane, automobile, toy including sporting equipment or the like, vegtable, fruit, etc. The particular object 15 on hand guard 12 is one of choice.

The foregoing devices and methods have been described in the foregoing specification for the purpose of illustration and not limitation. Many other modifications and ramifications will naturally suggest themselves to those skilled in the art based on this disclosure. These are intended to be comprehended as within the scope of this invention.

The embodiments of the invention in which an exclusive property or privilege is claimed are defined as follows:

1. A device for hand feeding infants and small children comprising in combination an utensil and a removable elastomeric hand guard which is fitted around the utensil handle near the food carrying portion of said utensil, said guard having a broad surface facing but sloping away from said food portion and simulating an object on said slope, said guard having a base portion which extends along said handle for such a length as to be directly under said slope for at least a third of the length of said sloping surface, said base portion having means to provide free standing stability to said guard, said guard because of its elastomeric properties having a handle opening being capable of varying in size to meet the change of size of said handle as said guard is moved along the length of said handle, said hand guard being capable of amusing small children when removed from said utensil.

2. The device of claim 1 wherein the utensil is a spoon.

3. The device of claim 1 wherein the utensil is a fork.

4. The device of claim 1 wherein the base portion extends under the slope for at least half the length of the slope.

5. The device of claim 1 wherein the object has the shape of a human face.

* * * * *